US009232843B2

(12) United States Patent
Li et al.

(10) Patent No.: US 9,232,843 B2
(45) Date of Patent: Jan. 12, 2016

(54) NAIL POLISH CURING DEVICE

(71) Applicant: Beauty Bela Cosme Corp., Taichung (TW)

(72) Inventors: Yu-Jen Li, Taichung (TW); Yi-Min Wang, Taichung (TW); I-Chen Hsieh, Taichung (TW)

(73) Assignee: Beauty Bela Cosme Corp., Taichung (TW)

( * ) Notice: Subject to any disclaimer, the term of this patent is extended or adjusted under 35 U.S.C. 154(b) by 391 days.

(21) Appl. No.: 13/940,188

(22) Filed: Jul. 11, 2013

(65) Prior Publication Data

US 2014/0338215 A1 Nov. 20, 2014

(30) Foreign Application Priority Data

May 17, 2013 (TW) ..... 102117566 A
May 29, 2013 (TW) ..... 102210029 U

(51) Int. Cl.
*A45D 29/00* (2006.01)

(52) U.S. Cl.
CPC ..... *A45D 29/00* (2013.01)

(58) Field of Classification Search
USPC ..... 250/455.11
See application file for complete search history.

(56) References Cited

U.S. PATENT DOCUMENTS 5,130,551 A * 7/1992 Nafziger ..... A45D 29/18 118/642
5,249,367 A * 10/1993 Nafziger ..... A45D 29/18 34/202
6,762,425 B1 * 7/2004 Strait ..... A45D 29/00 250/455.11
2013/0161531 A1 * 6/2013 Haile ..... B01J 19/123 250/455.11

* cited by examiner

*Primary Examiner* — Phillip A Johnston
(74) *Attorney, Agent, or Firm* — DLA Piper LLP (US)

(57) ABSTRACT

A nail polish curing device comprises: a lower part having a top surface and a reflective lower recess-defining surface that extends downwardly from the top surface and that defines a lower recess; an upper part disposed above the lower part and having a top wall, a bottom surface, and a reflective upper recess-defining surface that extends upwardly from the bottom surface and that defines an upper recess, the top wall being formed with a plurality of through-holes; a circuit board mounted on the top wall of the upper part; and a plurality of light emitting elements mounted on and electrically connected to the circuit board and extending respectively through the through-holes into the upper recess so as to emit light into the upper and lower recesses.

7 Claims, 7 Drawing Sheets

NAIL POLISH CURING DEVICE

CROSS-REFERENCE TO RELATED APPLICATION

This application claims priority of Taiwanese Application Nos. 102117566 and 102210029, filed respectively on May 17, 2013 and May 29, 2013.

BACKGROUND OF THE INVENTION

1. Field of the Invention

This invention relates to a nail polish curing device, more particularly to a nail polish curing device that facilitates relatively uniform curing, and that is operable to change a height of an irradiating space for accommodating a finger or a toe of a user.

2. Description of the Related Art

U.S. Pat. No. 6,762,425 discloses a conventional nail polish curing device that includes a housing, three partitions which divide the housing into first, second and third compartments, and three UV lamps mounted in the first, second and third compartments, respectively. The index, middle, ring and little fingers of one hand of a user can be placed in the first compartment for curing a nail polish material on fingernails thereof by the first UV lamp. The thumb of the hand of the user can be placed in the second compartment for curing the nail polish material on a thumb nail thereof by the second UV lamp. The toes of one foot of the user can be placed in the third compartment for curing the nail polish material on toenails thereof by the third UV lamp. Although the conventional nail polish curing device can simultaneously cure the nail polish material on the fingernails of all five fingers of one hand and the toenails of all five toes of one foot of the user, non-uniform curing of the nail polish material on the fingernails or the toenails is likely to occur. In addition, the conventional nail polish curing device is relatively bulky, and the height of each of the first, second and third compartments is fixed and cannot be adjusted.

SUMMARY OF THE INVENTION

Therefore, an object of the present invention is to provide a nail polish curing device that can overcome the aforesaid drawbacks associated with the prior art.

According to this invention, there is provided a nail polish curing device that comprises: a lower part having a top surface and a reflective lower recess-defining surface that extends downwardly from the top surface and that defines a lower recess; an upper part disposed above the lower part and having a top wall, a bottom surface, and a reflective upper recess-defining surface that extends upwardly from the bottom surface and that defines an upper recess, the top wall confining an upper side of the upper recess-defining surface and being formed with a plurality of through-holes; a circuit board mounted on the top wall of the upper part; and a plurality of spaced apart light emitting elements mounted on and electrically connected to the circuit board and extending respectively through the through-holes into the upper recess so as to emit light into the upper and lower recesses. The lower recess-defining surface reflects light emitted from the light emitting elements to the upper recess-defining surface in different directions, and the upper recess-defining surface reflects the reflected light from the lower recess-defining surface toward a user's finger that is placed on the lower recess-defining surface in different directions.

BRIEF DESCRIPTION OF THE DRAWINGS

In drawings which illustrate an embodiment of the invention.

DETAILED DESCRIPTION OF THE PREFERRED EMBODIMENT

Figure 1:
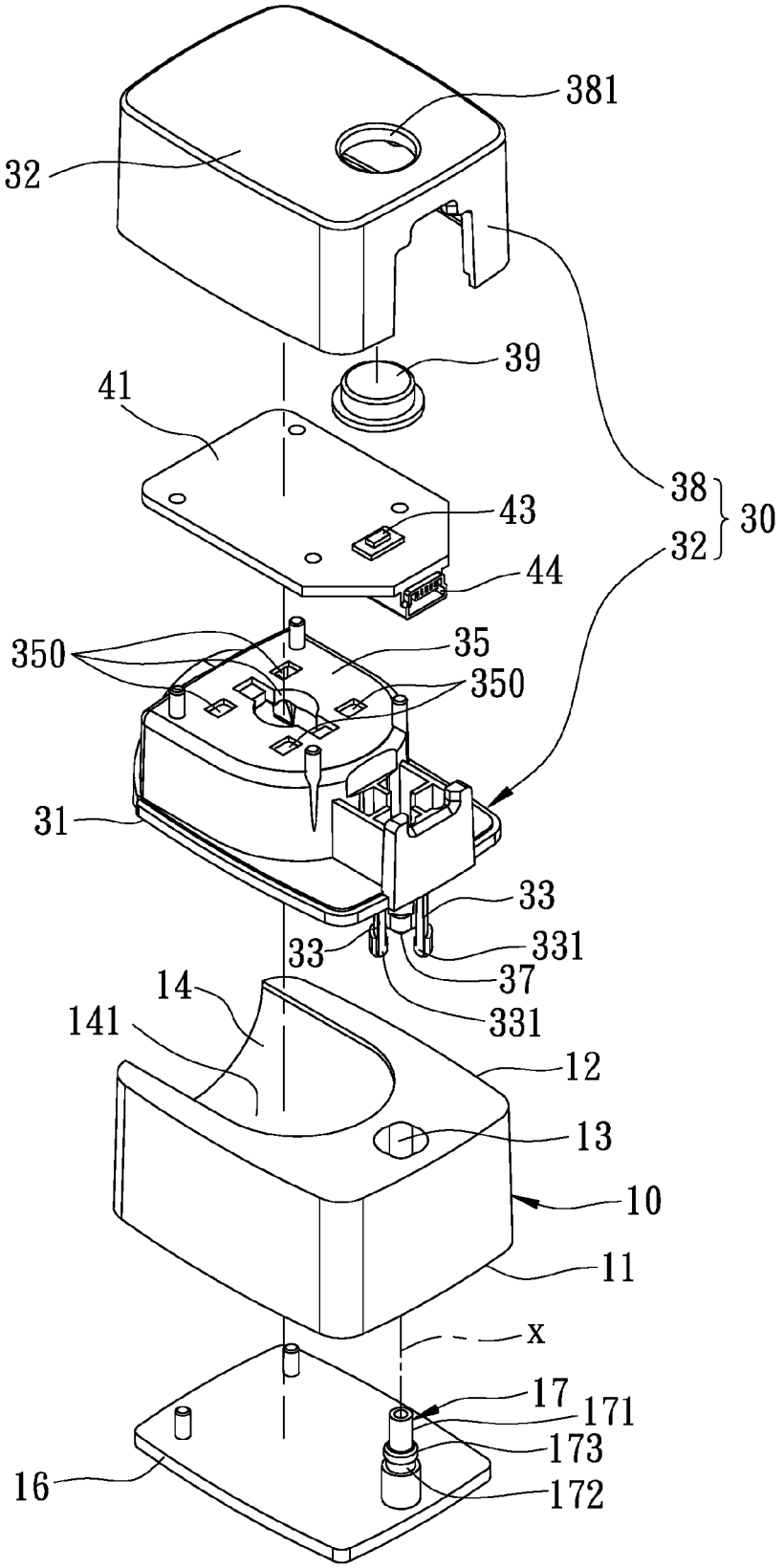
FIG. 1 is an exploded perspective view of the preferred embodiment of a nail polish curing device according to the present invention.
Figure 2:
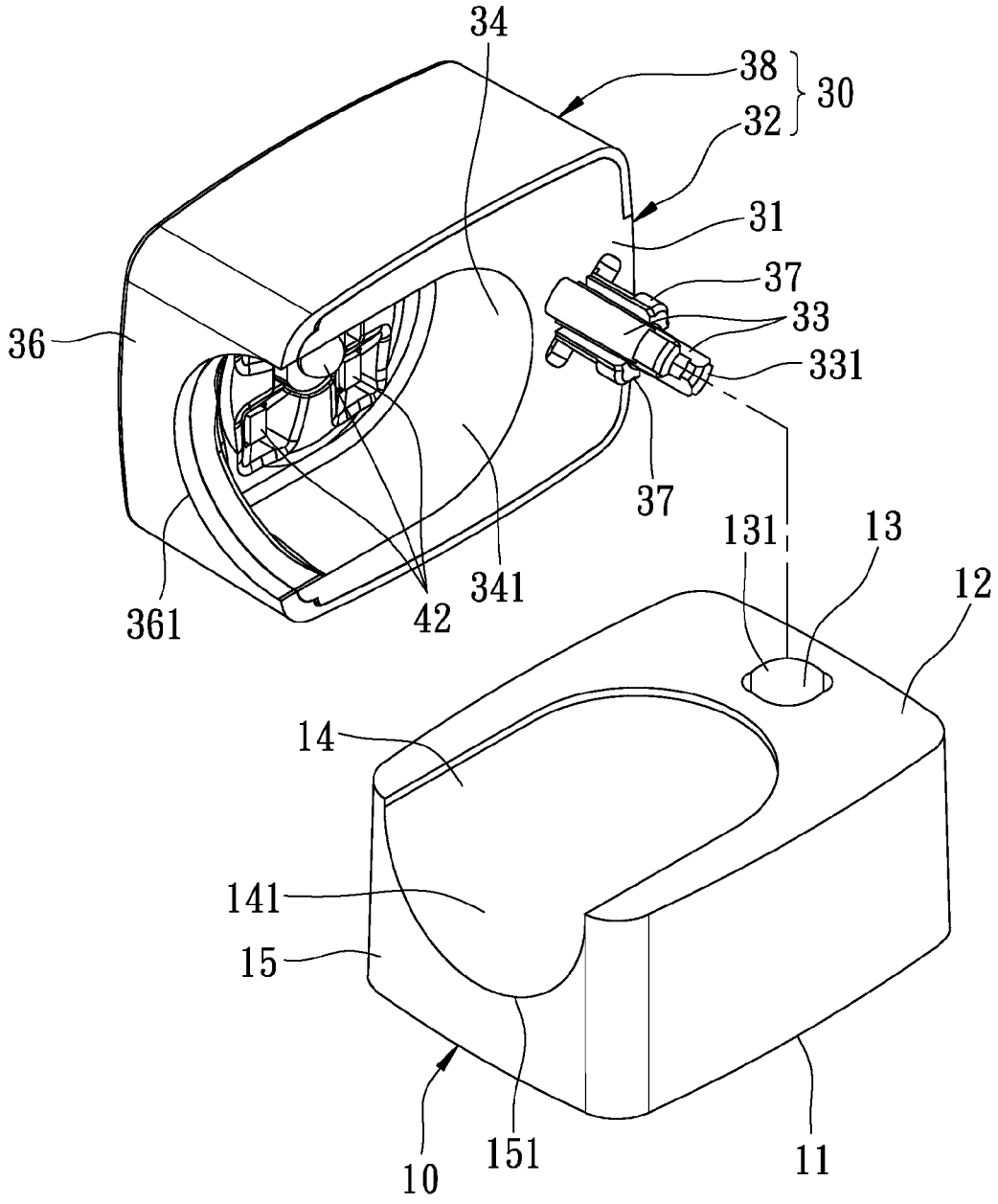
FIG. 2 is another exploded perspective view of the preferred embodiment.
Figure 3:
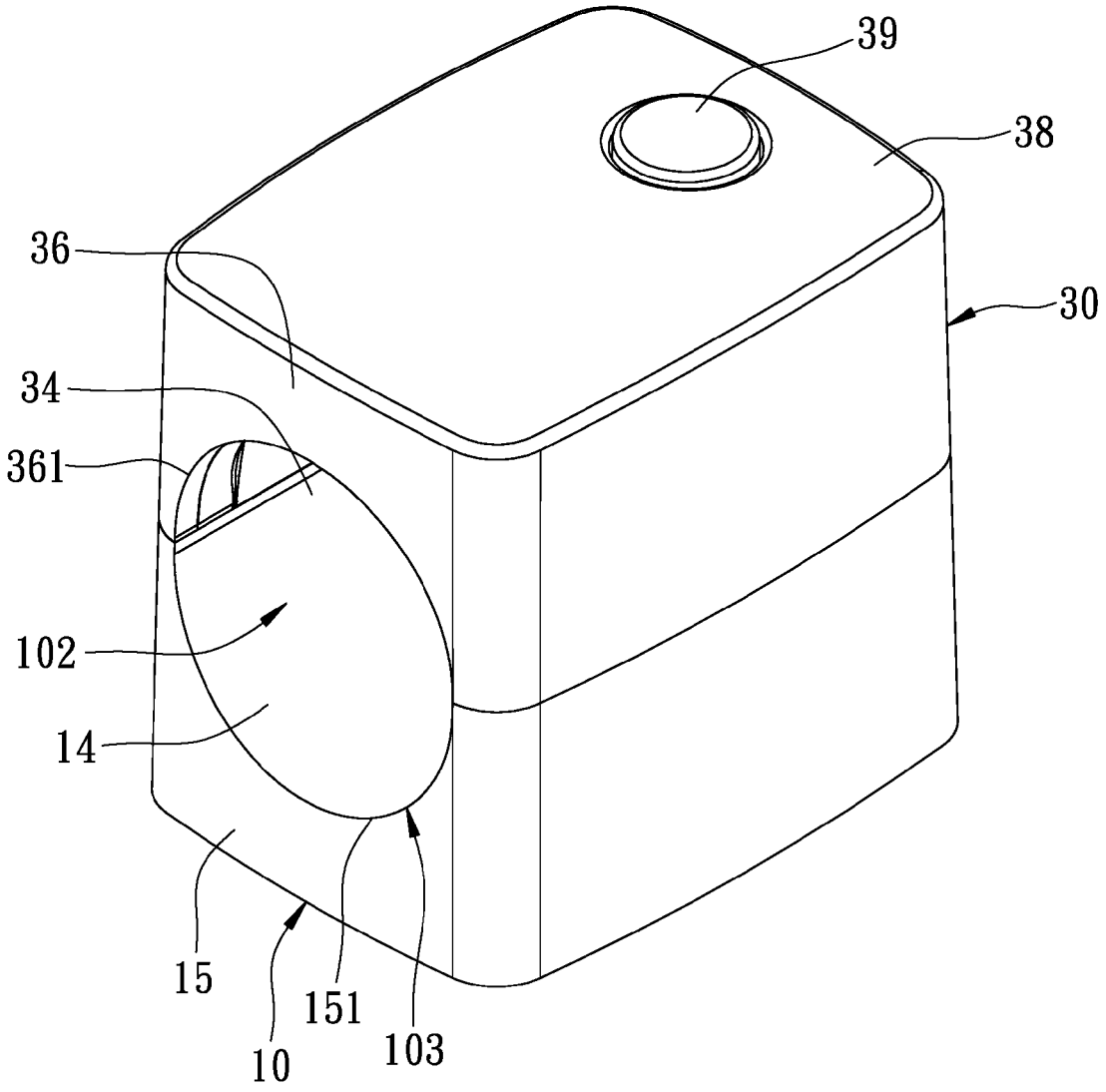
FIG. 3 is an assembled perspective view of the preferred embodiment.
Figure 4:
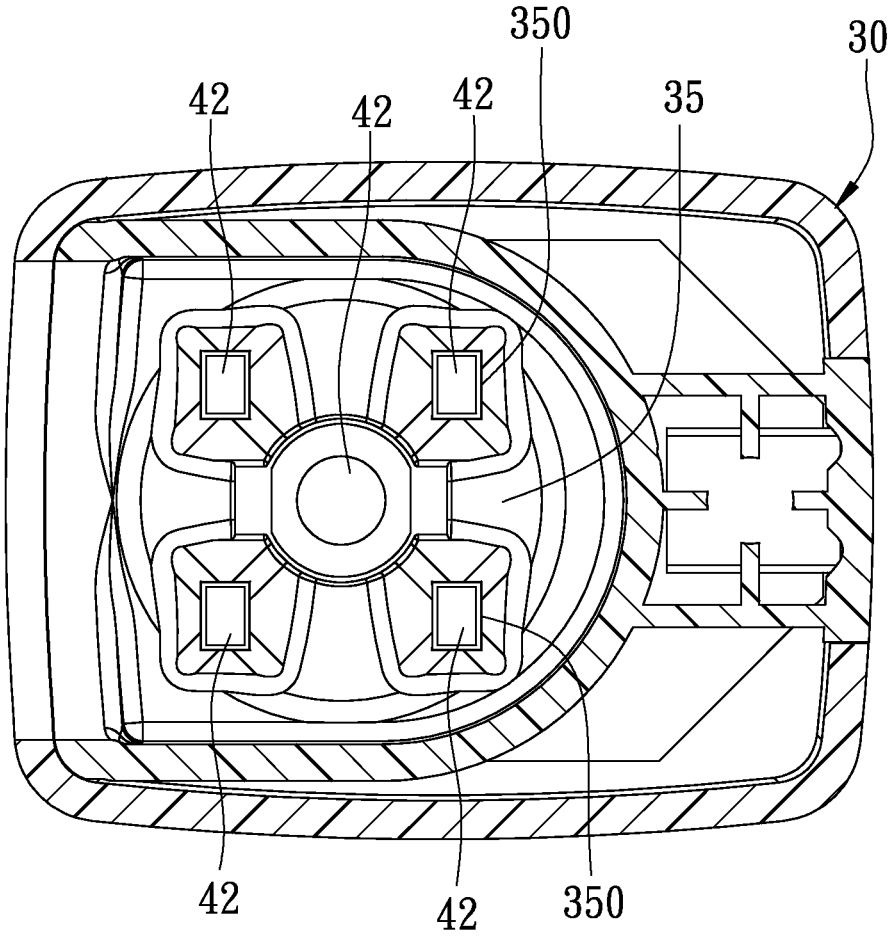
FIG. 4 is a sectional view illustrating an arrangement of light emitting elements mounted on an upper part of the preferred embodiment.
Figure 5:
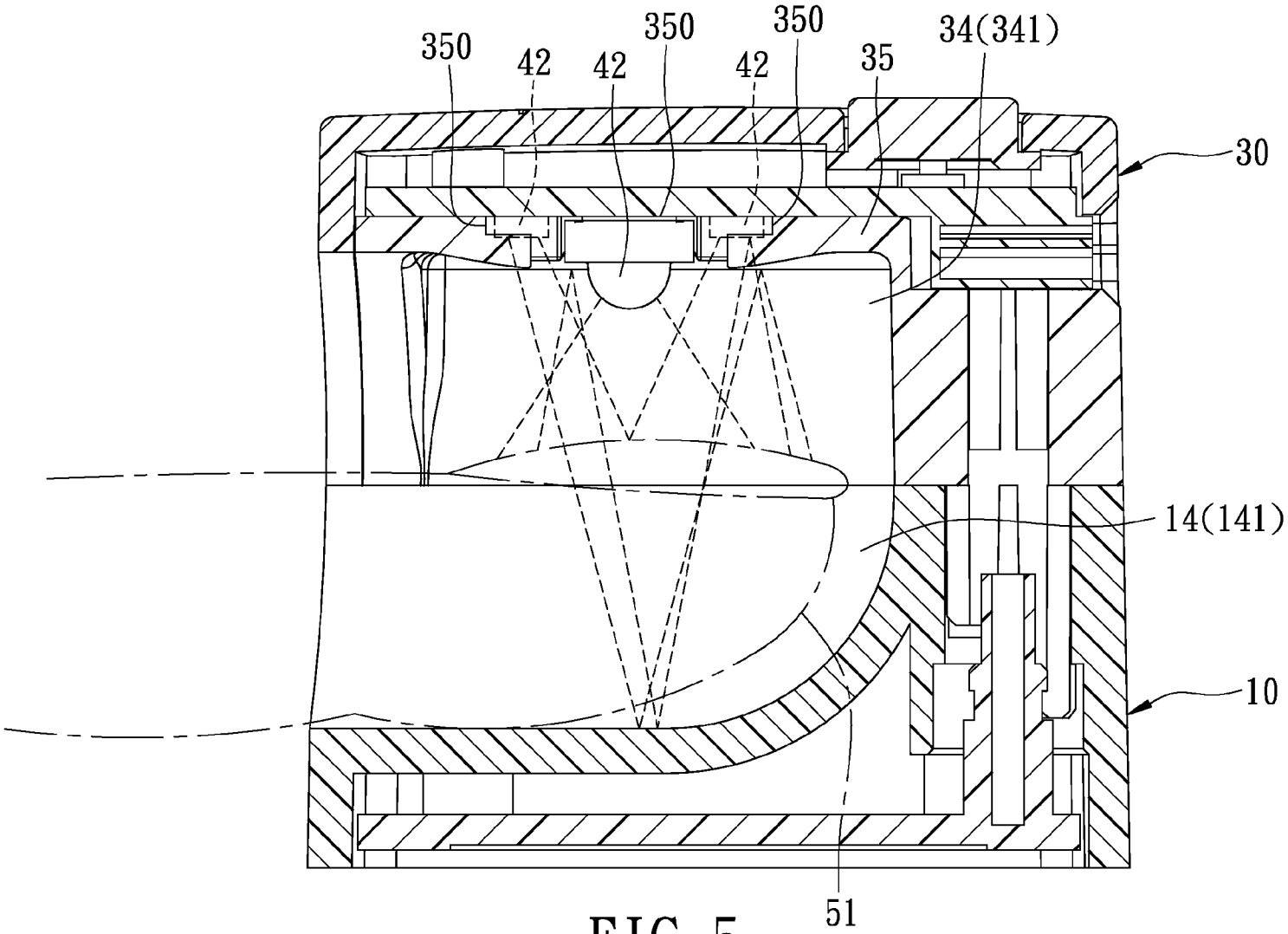
FIG. 5 is a sectional view illustrating a state where light emitted from the light emitting elements is reflected by a reflective lower recess-defining surface of a lower part of the preferred embodiment.

FIGS. 1 to 5 illustrate the preferred embodiment of a nail polish curing device according to this invention for curing a light-curable nail polish material on a finger of one hand or a toe of a foot of a user. The nail polish curing device includes a lower part 10, an upper part 30, a circuit board 41, a plurality of spaced apart light emitting elements 42, two first clamping arms 33, two second clamping arms 37, a pressable switch 43, a universal serial bus (USB) connector 44, and a pressable button 39.

The lower part 10 has a top surface 12, a front wall 15 that is formed with a lower front opening 151, and a reflective recess-defining surface 141 that extends downwardly from the top surface 12 and that defines a lower recess 14.

Figure 6:
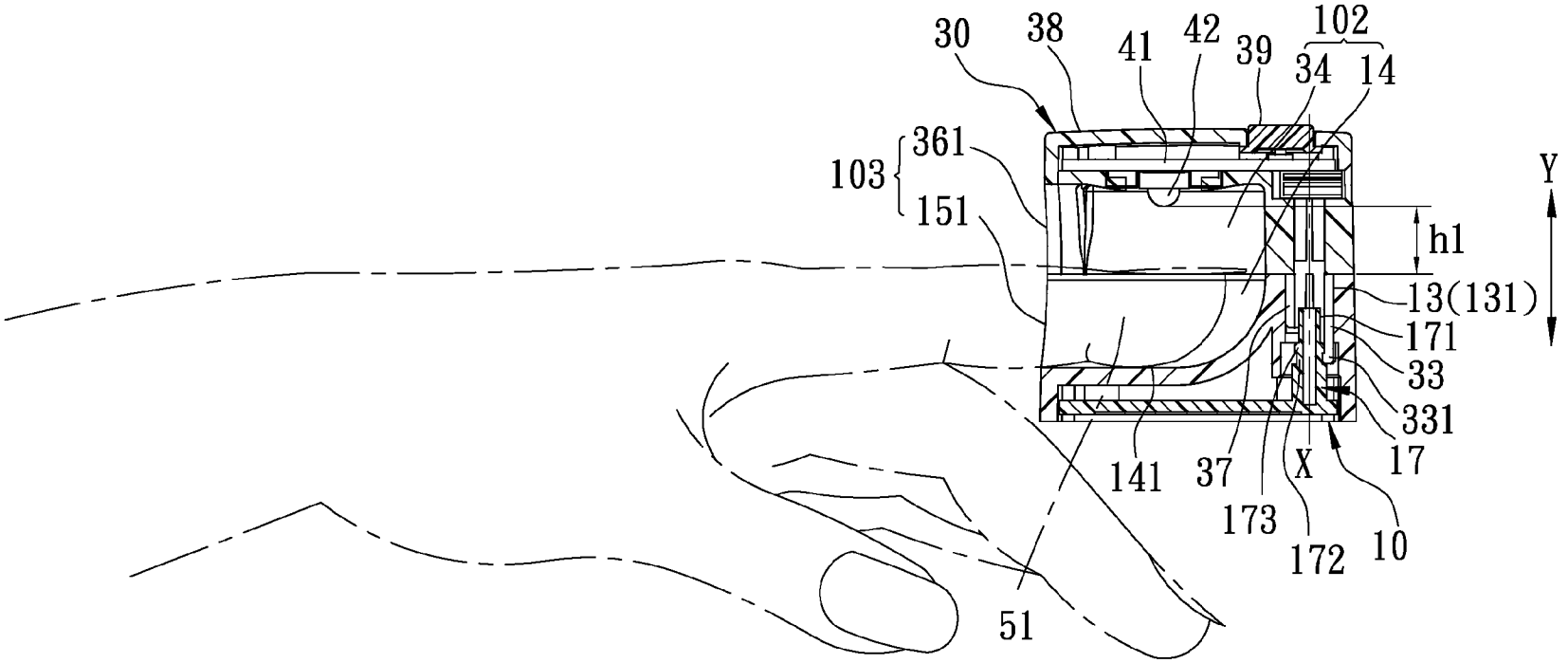
FIG. 6 is a sectional view illustrating a state where an upper part of the preferred embodiment is disposed at a first angular position.
Figure 7:
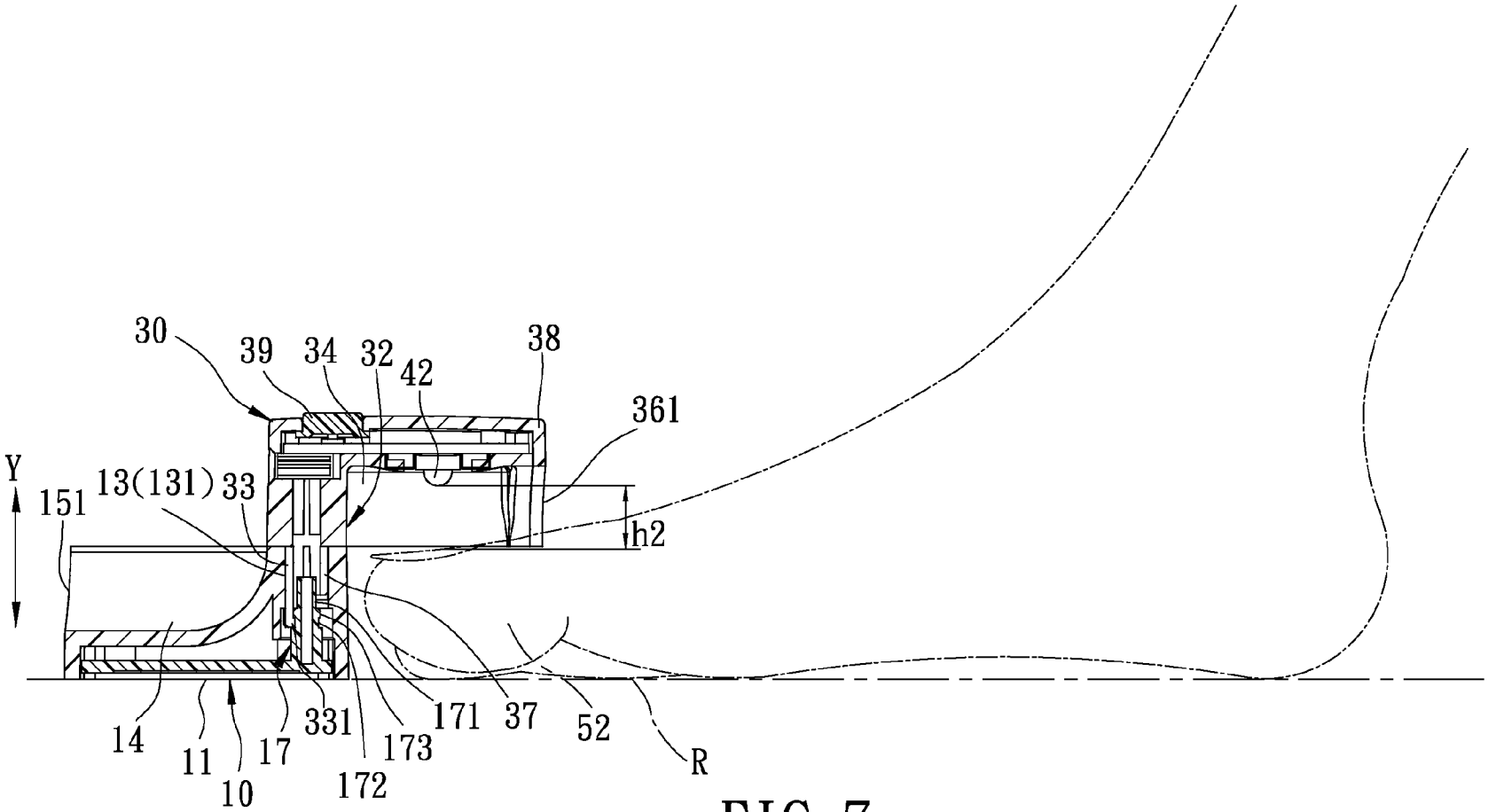
FIG. 7 is a sectional view illustrating another state where the upper part of the preferred embodiment is disposed at a second angular position.

The upper part 30 is disposed above the lower part 10, and is pivoted to the lower part 10 so as to be rotatable relative to the lower part 10 about an axis (X) between first and second angular positions (see FIGS. 6 and 7). The upper part 30 has a top wall 35, a bottom surface 31, a front wall 36 that is formed with an upper front opening 361, and a reflective recess-defining surface 341 that extends upwardly from the bottom surface 31 and that defines an upper recess 34. The top wall 35 confines an upper side of the upper recess-defining surface 341, and is formed with a plurality of through-holes 350.

The circuit board 41 is mounted on the top wall 35 of the upper part 30. The light emitting elements 42 are mounted on and electrically connected to the circuit board 41, and extend respectively through the through-holes 350 into the upper recess 34 for emitting light into the upper and lower recess 34, 14. The lower recess-defining surface 141 reflects light emitted from the light emitting elements 42 to the upper recess-defining surface 341 in different directions, and the upper recess-defining surface 341 reflects the reflected light from the lower recess-defining surface 141 toward a user's finger 51 (see FIG. 5) that is placed on the lower recess-defining surface 141, in different directions, thereby permitting uniform curing of the nail polish material on the finger 51.

In this embodiment, the lower recess-defining surface 141 is curved in shape, and at least a portion of the upper recess-defining surface 341 is curved in shape. The light emitting elements 42 are arranged in such a manner that one of the light emitting elements 42 is centrally surrounded by the remaining light emitting elements 42. The central one of the light emitting elements 42 has a power rating (unit: Watt per inch) preferably greater than those of the remaining light emitting elements 42, and more preferably five times greater than those of the remaining light emitting elements 42. The upper and lower recess-defining surfaces 341, 141 are made of a reflective material, such as a metal foil and a silver or white colored pigment.

In addition, other advantages of the nail polish curing device of this invention are as follows. When the upper part 30 is disposed at the first angular position (see FIG. 6) relative to the lower part 10, the upper and lower recesses 34, 14 overlap along a vertical direction (Y) and cooperatively define an accommodating space 102 in the nail polish curing device, and the upper and lower front openings 361, 151 overlap along the vertical direction (Y) and cooperatively define an inlet opening 103 of the nail polish curing device that is in spatial communication with the accommodating space 102, thereby permitting insertion of one of fingers 51 of a user into the accommodating space 102 via the inlet opening 103 and enabling the fingernail of said one of the fingers 51 to be spaced apart from a central one of the light emitting elements 42 by substantially a predetermined distance (h1) in the vertical direction (Y) when said one of the fingers 51 is placed on the recess-defining surface 141 of the lower part 10 with the fingernail facing upwardly.

The vertical direction (Y) is parallel to the axis (X). The predetermined distance (h1) is an optimum height that allows the nail polish material on the finger 51 to be uniformly cured in a relatively short amount of time and that facilitates formation of high quality nail polish on the fingernails.

The accommodating space 102 of the preferred embodiment has a size that can accommodate only one finger 51. Alternatively, the size of the accommodating space 102 can be varied such that it can accommodate two or more fingers 51 based on the actual requirements.

Unlike the fingers having excellent flexibility, it is difficult or inconvenient for each foot toe to get into the accommodating space 102 via the inlet opening 103 due to the lack of flexibility. In addition, since the structure and sizes of the foot toes are different from those of the fingers, the distance between the central one of the light emitting elements 42 and the toenail of a foot toe which is inserted into the accommodating space 102 may considerably deviate from the predetermined distance (h1), which can result in poor quality nail polish on the toenail. The aforesaid difficulty or inconvenience and the deviation from the predetermined distance (h1) can be eliminated or alleviated by disposing the upper part 30 at the second angular position relative to the lower part 10. When the upper part 30 is disposed at the second angular position (see FIG. 7) relative to the lower part 10, the upper and lower recesses 34, 14 do not overlap along the vertical direction (Y), and the upper and lower front openings 361, 151 do not overlap along the vertical direction (Y), thereby facilitating insertion of one of toes 52 of one foot of the user into an irradiating space between the bottom surface 31 of the upper part 30 and a reference surface (R), such as a floor, a foot rest, a chair, etc., on which the foot rests, and permitting the toenail of said one of the toes 52 to be spaced apart from the central one of the light emitting elements 42 in the vertical direction (Y) by substantially a distance (h2) close to the predetermined distance (h1).

The upper part 30 can be rotated either in a rotational direction or an opposite rotational direction by an angel of between 90 degrees and 180 degrees relative to the lower part 10 about the axis (X). In this embodiment, the upper part 30 is rotated by 180 degrees relative to the lower part 10 about the axis (X) when rotating from the first angular position to the second angular position.

The bottom surface 31 of the upper part 30 overlaps and contacts the upper surface 12 of the lower part 10 along the entire length of the lower part 10 when the upper part 30 is disposed at the first angular position relative to the lower part 10 so that the inlet opening 103 has a continuous close-looped shape and that the light emitted from the light emitting elements 42 can be blocked by the upper and lower parts 30, 10 so as to be confined in the accommodating space 102 except by passing through the inlet opening 103.

In this embodiment, the upper part 30 has a main piece 32 that defines the upper recess 34, and a cover piece 38 that is detachably connected to and that cooperates with the main piece 32 to define the upper front opening 361. The cover piece 38 covers a top side, two lateral sides and a rear side of the main piece 32, and is formed with a button-hole 381. The circuit board 41 is mounted on the top side of the main piece 32.

The first clamping arms 33 are diametrically disposed, and extend downwardly from the bottom surface 31 of the upper part 30 in the vertical direction (Y). The lower part 10 further has a bottom wall 16 and a pivot shaft 17 extending upwardly from the bottomwall 16 in the vertical direction (Y), and is formed with a pivot hole 13 extending through the top surface 12 of the lower part 10 in the vertical direction (Y) and defined by a hole-defining wall 131. The pivot shaft 17 extends into the pivot hole 13, and is spaced apart from the hole-defining wall 131. The first clamping arms 33 extend into the pivot hole 13 and are disposed between and in frictional contact with the hole-defining wall 131 and the pivot shaft 17 so as to clamp the pivot shaft 17 and to permit rotation of the upper part 30 relative to the lower part 10 about the axis (X). The first clamping arms 33 are in snap-fit engagement with the pivot shaft 17.

The second clamping arms 37 are diametrically disposed, extend downwardly from the bottom surface 31 of the upper part 30 in the vertical direction (Y), and are angularly displaced with the first clamping arms 33. The pivot shaft 17 has upper and lower portions 171, 172 and a flange 173 that is disposed between and that protrudes outwardly and radially from the upper and lower portions 171, 172. Each of the first clamping arms 33 has a hook end 331. The hook ends 331 of the first clamping arms 33 clamp the lower portion 172 of the pivot shaft 17, and are in snap-fit engagement with the flange 173. The second clamping arms 37 extend into the pivot hole 13 and are disposed between and in frictional contact with the hole-defining wall 131 and the upper portion 171 of the pivot shaft 17 so as to clamp the upper portion 171 of the pivot shaft 17.

The pressable switch 43 is mounted on and electrically connected to the circuit board 41. The pressable button 39 is movably mounted on the cover 38, and extends through the button-hole 381 to contact the pressable switch 43 so as to permit the user to press the pressable switch 43 to control the operating states of the light emitting elements 42. The light emitting elements 42 can be light emitting diode (LED) devices.

The USB connector 44 is mounted on and electrically connected to the circuit board 41 and is adapted to be connected to a power source (not shown) for providing power to the circuit board 41.

By forming the reflective upper and lower recess-defining surfaces 341, 141 and by connecting pivotally the upper part 30 to the lower part 10 of the nail polish curing device of this invention, the aforesaid drawbacks associated with the prior art can be eliminated.

While the present invention has been described in connection with what is considered the most practical and preferred embodiment, it is understood that this invention is not limited to the disclosed embodiment but is intended to cover various arrangements included within the spirit and scope of the broadest interpretation and equivalent arrangements.

What is claimed is:

1. A nail polish curing device comprising:

a lower part having a top surface and a reflective lower recess-defining surface that extends downwardly from said top surface and that defines a lower recess;

an upper part disposed above said lower part and having a top wall, a bottom surface, and a reflective upper recess-defining surface that extends upwardly from said bottom surface and that defines an upper recess, said top wall confining an upper side of said upper recess-defining surface and being formed with a plurality of through-holes;

a circuit board mounted on said top wall of said upper part; and a plurality of spaced apart light emitting elements mounted on and electrically connected to said circuit board and extending respectively through said through-holes into said upper recess so as to emit light into said upper recess;

wherein said lower recess-defining surface reflects light emitted from said light emitting elements to said upper recess-defining surface in different directions, and said upper recess-defining surface reflects the reflected light from said lower recess-defining surface toward a user's one finger that is placed on said lower recess-defining surface in different directions.

2. The nail polish curing device of claim 1, wherein said lower recess-defining surface is curved in shape, and at least a portion of said upper recess-defining surface is curved in shape.

3. The nail polish curing device of claim 1, wherein said light emitting elements are arranged in such a manner that one of said light emitting elements is centrally surrounded by the remaining ones of said light emitting elements.

4. The nail polish curing device of claim 3, wherein said lower part further has a front wall that is formed with a lower front opening, and said upper apart further has a front wall that is formed with an upper front opening;

wherein said upper part is pivoted to said lower part so as to be rotatable relative to said lower part about an axis between first and second angular positions;

wherein when said upper part is disposed at the first angular position relative to said lower part, said upper and lower recesses overlap along a vertical direction and cooperate with each other to define an accommodating space in said nail polish curing device, and said upper and lower front openings overlap along the vertical direction and cooperate with each other to define an inlet opening of said nail polish curing device that is in spatial communication with said accommodating space, thereby permitting insertion of one finger of a user into said accommodating space via said inlet opening and enabling the fingernail of said one finger to be spaced apart from said one of said light emitting elements substantially by a predetermined distance in the vertical direction when said one finger is placed on said recess-defining surface of said lower part with the fingernail facing upwardly, the vertical direction being parallel to the axis; and when said upper part is disposed at the second angular position relative to said lower part, said upper and lower recesses do not overlap along the vertical direction, and said upper and lower front openings do not overlap along the vertical direction, thereby facilitating insertion of one toe of one foot of the user into an irradiating space between said bottom surface of said upper part and a reference surface on which the foot rests and permitting the toenail of said one toe to be spaced apart from said one of said light emitting elements in the vertical direction substantially by a distance close to the predetermined distance.

5. The nail polish curing device of claim 4, further comprising two first clamping arms that are diametrically disposed and that extend downwardly from said bottom surface of said upper part in the vertical direction, said lower part further having a bottom wall and a pivot shaft that extends upwardly from said bottom wall in the vertical direction, and that is formed with a pivot hole, which extends through said top surface of said lower part in the vertical direction and which is defined by a hole-defining wall, said pivot shaft extending into said pivot hole and being spaced apart from said hole-defining wall, said first clamping arms extending into said pivot hole and being disposed between and in frictional contact with said hole-defining wall and said pivot shaft so as to clamp said pivot shaft and so as to permit rotation of said upper part relative to said lower part about the axis, said first clamping arms being in snap-fit engagement with said pivot shaft.

6. The nail polish curing device of claim 5, further comprising two second clamping arms that are diametrically disposed, that extend downwardly from said bottom surface of said upper part in the vertical direction, and that are angularly displaced with said first clamping arms, said pivot shaft having upper and lower portions and a flange that is disposed between and that protrudes outwardly and radially from said upper and lower portions, each of said first clamping arms having a hook end, said hook ends of said first clamping arms clamping said lower portion of said pivot shaft and being in snap-fit engagement with said flange, said second clamping arms extending into said pivot hole and being disposed between and in frictional contact with said hole-defining wall and said upper portion of said pivot shaft so as to clamp said upper portion of said pivot shaft.

7. The nail polish curing device of claim 4, wherein said bottom surface of said upper part overlaps and contacts said upper surface of said lower part along the entire length of said lower part when said upper part is disposed at the first angular position relative to said lower part.

* * * * *